US005862859A

United States Patent [19]

Speed et al.

[11] Patent Number: 5,862,859

[45] Date of Patent: Jan. 26, 1999

[54] SIDE POCKET MANDREL ORIENTING DEVICE WITH INTEGRALLY FORMED LOCATING SLOT

[75] Inventors: David Speed, Dallas; Robert Sharum, Garland, both of Tex.

[73] Assignee: CAMCO International Inc., Houston, Tex.

[21] Appl. No.: 565,536

[22] Filed: Nov. 30, 1995

[51] Int. Cl.[6] ..... E21B 23/03

[52] U.S. Cl. ..... 166/117.5

[58] Field of Search ..... 166/117.5, 117.6

[56] References Cited

U.S. PATENT DOCUMENTS

| | | | |
|---|---|---|---|
| Re. 32,441 | 6/1987 | Higgins et al. | 166/117.5 |
| 3,827,490 | 8/1974 | Moore, Jr. et al. | 166/117.5 |
| 4,106,564 | 8/1978 | Tausch | 166/117.5 |
| 4,440,222 | 4/1984 | Pullin | 166/117.5 |
| 4,462,465 | 7/1984 | Strickland | 166/117.5 |
| 4,524,833 | 6/1985 | Hilts et al. | 166/117.5 X |
| 4,553,310 | 11/1985 | Logan | 166/117.5 |
| 4,603,736 | 8/1986 | Moore | 166/117.5 |
| 4,757,859 | 7/1988 | Schnatzmeyer | 166/117.5 |

OTHER PUBLICATIONS

Otis Merlas Systems Side Pocket Mandrels, High Strength Tru Guide Side Pocket Mandrels, p. 22, (Undated).

*Primary Examiner*—David J. Bagnell
*Attorney, Agent, or Firm*—Arnold White & Durkee

[57] ABSTRACT

An improved side pocket mandrel having an orientation housing, which in turn has an orienting slot and guide surfaces integrally formed with the orientation housing. The orientation housing is preferably manufactured by machining out of a single piece of metal. The orientation housing is then welded onto the remainder of the side pocket mandrel.

10 Claims, 3 Drawing Sheets

SIDE POCKET MANDREL ORIENTING DEVICE WITH INTEGRALLY FORMED LOCATING SLOT

BACKGROUND OF THE INVENTION

1. Field of the Invention

This invention relates to gas lift apparatus and more particularly to side pocket mandrels for use in gas lift wells.

2. Description of the Prior Art

Side pocket mandrels have long been used in the industry to house well flow control devices, such as valves. These mandrels are referred to as "side pocket" because the valve is housed in a valve pocket section that is offset from the main bore diameter. By having the valve pocket section offset in the side pocket, tools traveling up and down the hole are less likely to accidentally strike the valve. A tool striking the valve could damage or otherwise render it inoperative. The damaged valve would then have to be replaced, an expensive and time consuming process during which the well would not be producing.

Modem side pocket mandrels house the valve in a side pocket section, to further protect the valve and prevent passing tools from damaging the valve. The side pocket section has a small hole in its top to allow appropriate tools, known as kickover tools, to enter the housing to interact with the valve.

Tools used to insert, remove or otherwise interact with the valves in the side pocket mandrels are referred to as "kickover" tools. Kickover tools must be properly rotationally oriented in the flowbore to be activated for entrance into the side pocket section. To orient the kickover tools, the upper end of the mandrel traditionally has an orienting sleeve that snugly fits inside of the mandrel. This sleeve is typically provided with a pair of guide surfaces that are generally helical in shape, leading from a point at the lower end of the sleeve upwardly to the lower end of a longitudinally-aligned orienting slot. This sleeve is generally cylindrical in shape, similar to the upper end of the mandrel, and fits snugly therein. In some cases, the slot in the sleeve may pass completely through the longitudinal length of the sleeve. In other mandrels, the slot may be provided with an end or shoulder, and in some cases this shoulder completely blocks the slot. Such a shoulder at the upper end of the slot is utilized in activating a kickover tool after it has first been oriented. The slot must be long enough so that the kickover tool can be kept properly aligned while the entire tool is pulled up past the opening to the side pocket section, and to maintain alignment of the kickover tool once activated and subsequently lowered to insert the kickover tool into the side pocket section.

Kickover tools of the orienting type are provided with an orienting key sufficiently narrow to enter the orienting slot in the orienting sleeve and have an abrupt upwardly facing shoulder thereon. When this abrupt shoulder engages the orienting sleeve, it will follow one of the guide surfaces causing the kickover tool to rotate about its longitudinal axis until the key becomes aligned with and enters the slot, thus orienting the kickover tool with respect to the side pocket mandrel, i.e., positioning the kickover tool for insertion into the entrance of the side pocket section of the side pocket mandrel. In some case, as where wireline equipment is used, the same abrupt shoulder of the orienting key also engages the shoulder in the slot, and further movement of the kickover tool causes it to be activated such that a portion thereof is shifted laterally into alignment with the entrance of the side pocket section of the side pocket mandrel.

In the prior art, the orienting slot is always wholly contained within the orienting sleeve, and the interior wall of the outer mandrel housing is uniformly smooth. The orienting sleeve is placed within the outer mandrel housing during construction of the side pocket mandrel. The sleeve must be long enough to provide a slot of sufficient length to allow the kickover tool to be fully activated and vertically positioned with respect to the side pocket section. That is, not only must the kickover tool be properly aligned, it must also be moved upward sufficiently so that the lower end of the kickover tool can enter the side pocket section.

During construction of the prior art side pocket mandrels, after the orienting sleeve is inserted and positioned inside the outer mandrel housing, the sleeve is welded to the interior wall of the outer mandrel housing, and the mandrel is welded shut, sealing the sleeve inside the outer mandrel housing.

Even though the sleeve fits snugly inside the outer mandrel housing, where the surfaces of the two parts meet creates suitable locations for crevice corrosion. Such corrosion can lead to mechanical failure.

Another problem with prior art side pocket mandrels is that the orienting sleeve can sometimes become detached from the walls of the mandrel, due to corrosion of its welds, the force of a tool striking it, or a combination of the two. When this happens, the orienting sleeve can become misaligned, or travel downhole, and not only must the side pocket mandrel be replaced, the orienting sleeve must sometimes be fished out of the hole.

As the side pocket mandrel is part of the production string, it is imperative that the side pocket mandrel not mechanically fail or have to be replaced, else production will have to be stopped while the entire production string is pulled and the mandrel replaced. Therefore, it is an object of the present invention to provide a side pocket mandrel which has less area for crevice corrosion present and is less prone to breakage.

SUMMARY OF THE INVENTION

The above cited objectives are met by the inventive side pocket mandrel. Instead of having a separate orienting sleeve that is inserted into two sections of the mandrel housing, the inventive device has the orienting "sleeve" integrally formed with the upper section of the mandrel, this piece being called an orientation housing. This is preferably accomplished by machining the orientation housing, which contains the upper section of mandrel housing and the orienting guide surfaces and slot, all from a single piece of metal. This eliminates completely the possibility of crevice corrosion between an orienting sleeve and an upper section of mandrel housing, as well as the possibility of the orienting sleeve separating from the inner wall of the mandrel. The orientation housing can also be formed by any number of other well known methods in the industry, such as forging.

In the inventive structure, the slot is now integrally formed inside the orientation housing, and only the guide surfaces of the orientation housing having a smaller diameter. Another benefit of the inventive device is that the weld point for closing up the mandrel is moved much closer to the guide surfaces. The closer this weld is to the guide surfaces, the less lateral stresses will impinge on the guide surfaces during lateral loading, and the less likelihood of breakage of the mandrel housing at this critical junction in the mandrel.

DESCRIPTION OF THE PREFERRED EMBODIMENTS

In the following description, the terms "upper," "upward," "lower," "below," "downhole" and the like, as used herein, shall mean in relation to the bottom, or furthest extent of, the surrounding wellbore even though the wellbore or portions of it may be deviated or horizontal. Where components of relatively well known design are employed, their structure and operation will not be described in detail.

Figure 1A:
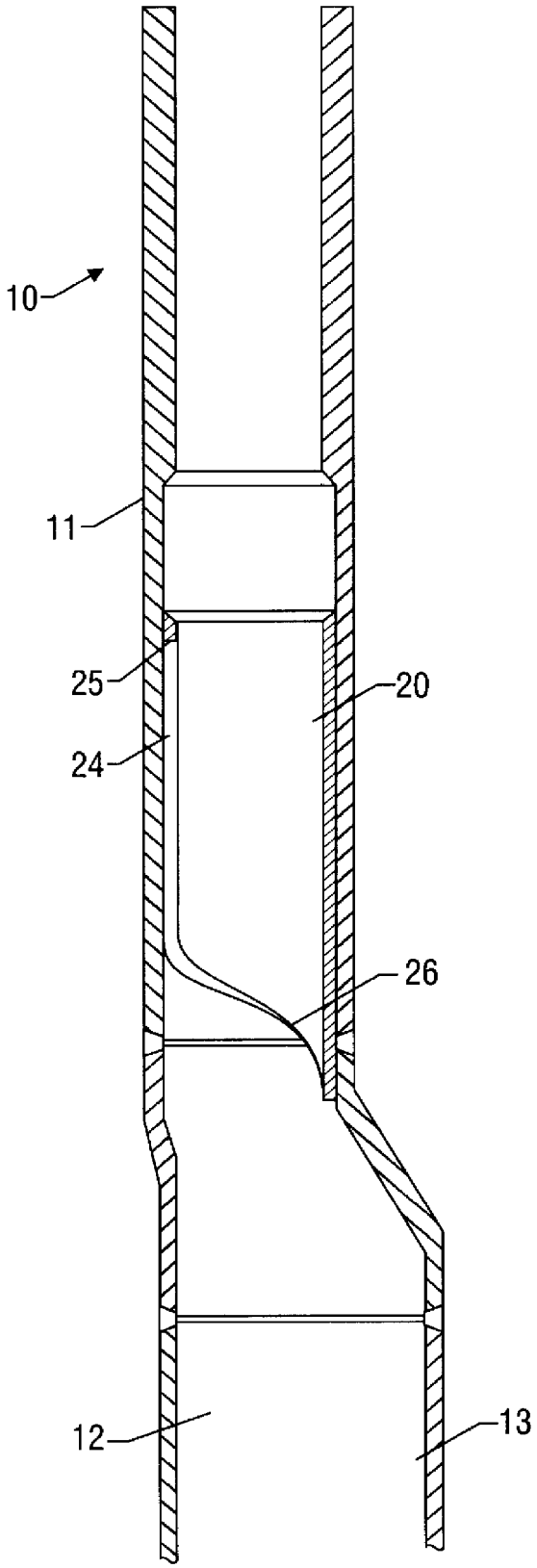
FIG. 1A (PRIOR ART)
FIG. 1A is a cross-sectional view of a portion of a prior art side pocket mandrel.
Figure 1B:
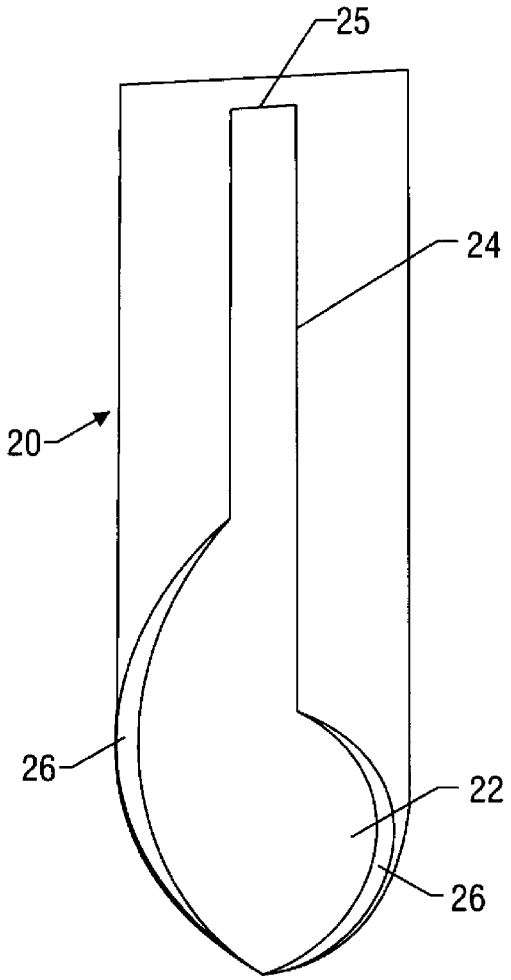
FIG. 1B (PRIOR ART)
FIG. 1B is a side elevation view of a prior art orientation sleeve.
Figure 2:
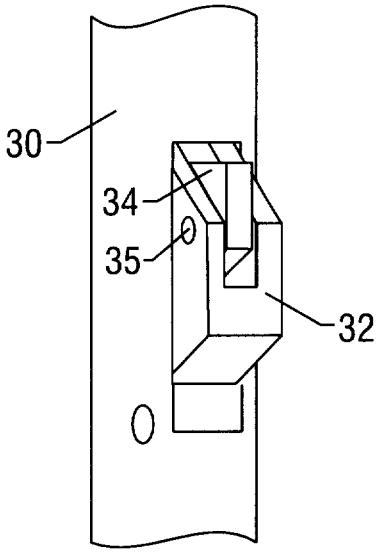
FIG. 2 (PRIOR ART)
FIG. 2 is a fragmentary side elevation view of a portion of a prior art kickover tool showing an orienting key.

Referring now to FIGS. 1A and 1B, which is a prior art embodiment, it will be seen that the side pocket mandrel is indicated generally by the numeral 10. It is thus shown provided with an outer mandrel housing 11 having a full-opening bore extending therethrough from end to end and a side pocket bore 13 extending alongside the main bore 12 and with means at its upper end for attachment to a string of well tubing (not shown). Near its upper end, the mandrel is provided with an orienting sleeve 20 which has a bore 22 which surrounds the main bore 12 through the mandrel. The orienting sleeve 20 is provided with a longitudinal orienting slot 24 having a downwardly facing shoulder 25 at the upper end thereof which blocks the slot. Sleeve 20 is further provided with a pair of downwardly facing guide surfaces 26 which are directed upward toward the lower end of the slot 24. These guide surfaces are engageable by an orienting key of a kickover tool (See FIG. 2). The guide key 32, upon engaging one of the guide surfaces, will follow it, causing the kickover tool 30 to rotate about its longitudinal axis until its orienting key becomes aligned with and enters the orienting slot 24. When the orienting key is in the orienting slot, the kickover tool is properly oriented in the side pocket mandrel with respect to the side pocket bore 13.

Once properly rotationally aligned, the entire kickover tool must be raised to a point above the side pocket bore, so that it can be inserted into the side pocket section. When the orienting key reaches the upper end of the slot, its filler piece 34 engages the shoulder 25, the filler piece 34 being held in operating position by the shear pin 35. Thus, upward movement of the orienting key 32 is arrested, and further upward movement of the kickover tool will cause relative longitudinal movement between the orienting key and the kickover tool and cause the kickover tool to be activated. With the orienting key in the orienting slot, the kickover tool is correctly oriented with respect to the side pocket bore 13, and the kickover tool can be operated to install a device therein or remove a device therefrom. It should be noted that the housing itself is uniformly axially smooth around the sleeve, and that the orienting slot is wholly a part of the sleeve.

Figure 3:
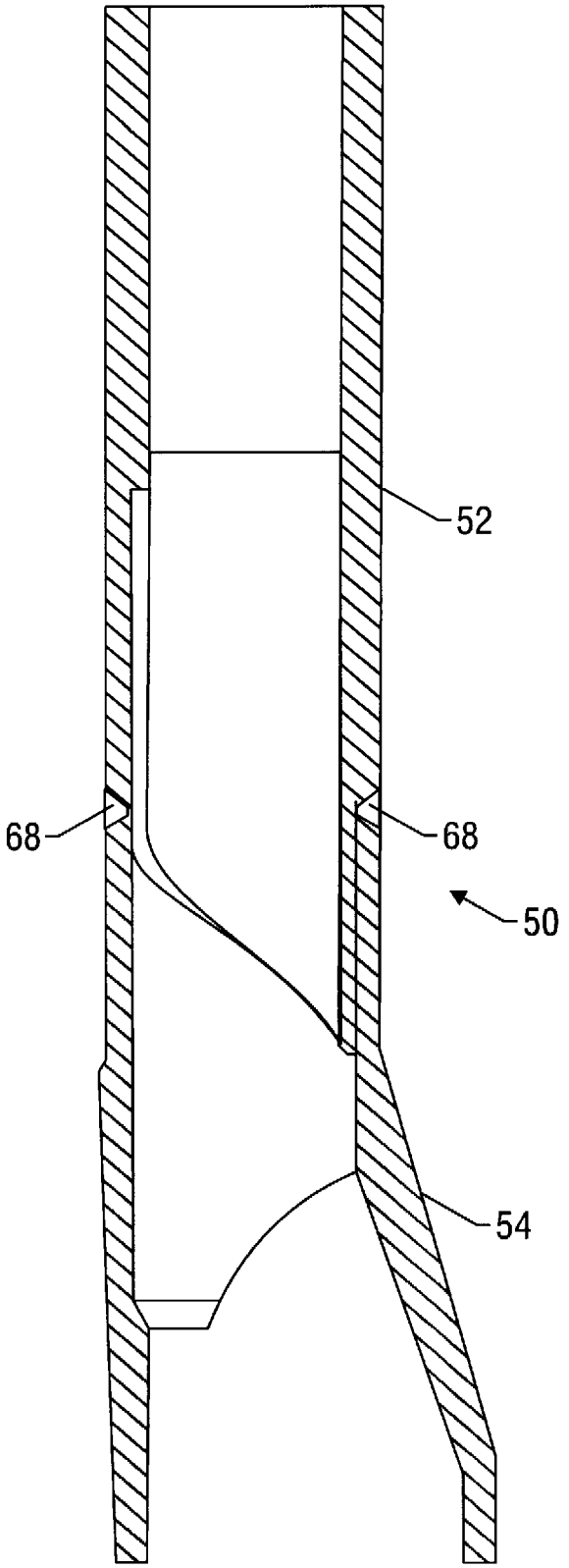
FIG. 3 is a cross-sectional view of a portion of a side pocket mandrel incorporating the features of the present invention.

Referring now to FIG. 3, in a preferred embodiment, a side pocket mandrel 50 comprises an orientation housing 52 and a lower housing 54. The orientation housing 52 is threaded at its upper end so that the side pocket mandrel can be connected into the production tubing (not shown). The primary longitudinal bore in the side pocket mandrel 50 is comparably to that of the production tubing it is attached to.

Figure 4A:
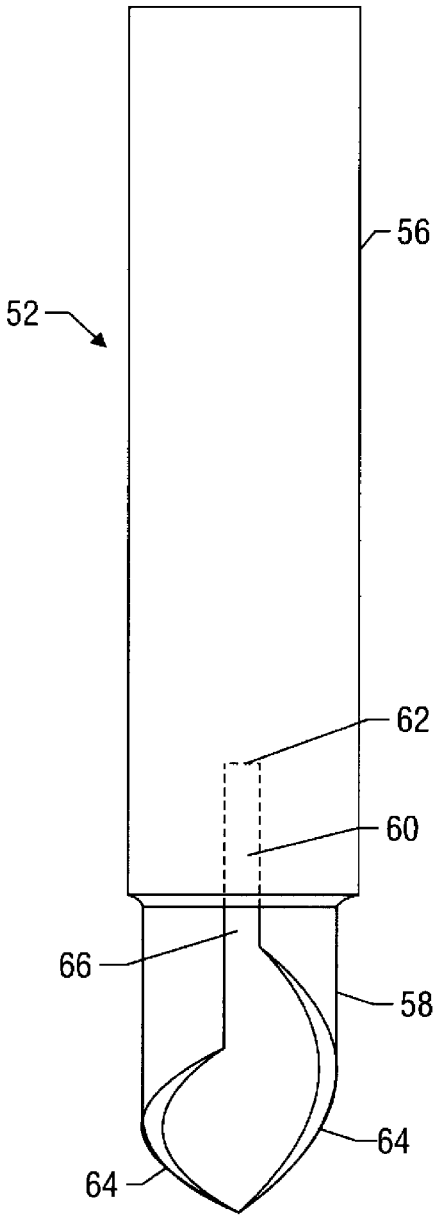
FIG. 4A is a side view of an orientation housing incorporating the features of the present invention.
Figure 4B:
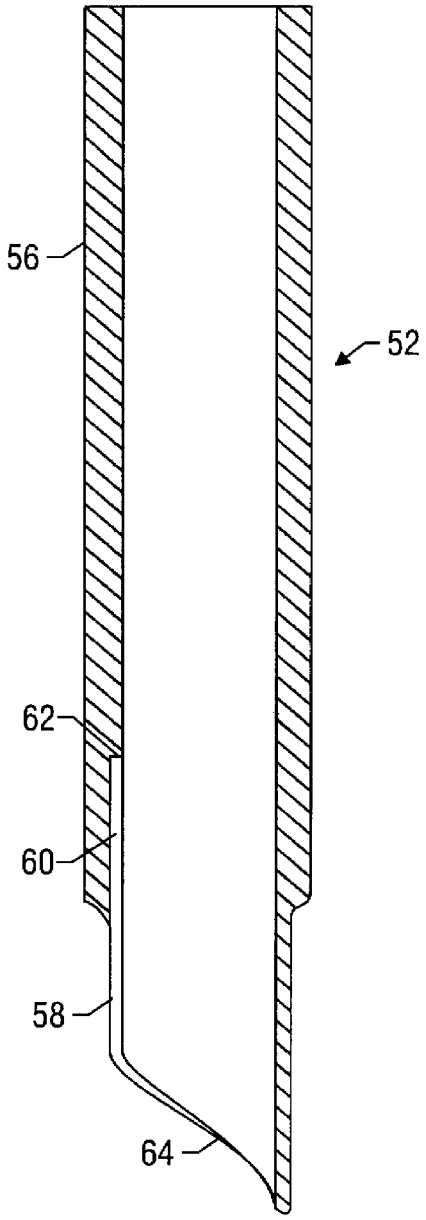
FIG. 4B is a cross-sectional view of an orientation housing incorporating the features of the present invention.
Figure 4C:
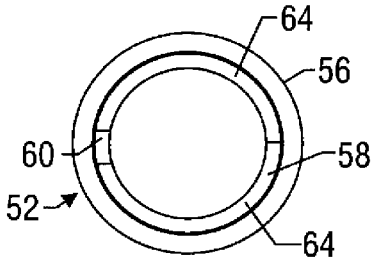
FIG. 4C is a bottom view of an orientation housing incorporating the features of the present invention.

The orientation housing 52 is shown in detail in FIGS. 4A–4C. As is seen, instead of having an orienting sleeve inserted and welded into a mandrel housing, the orientation housing contains the orienting sleeve and the upper section of mandrel housing, manufactured together as a single unit. The orientation housing is formed of a single piece of metal, thereby reducing weld sites, which are likelier locations for breakage and corrosion, as well as reducing area for crevice corrosion, which can also destroy the mandrel. Use of the inventive device also precludes the possibility of having an orienting sleeve separate from the inner walls of the mandrel and move downhole. The orientation housing is preferably manufactured by machining it out of a single piece of metal. The orientation housing can also be manufactured by other methods that are well known in the industry, such as forging, as well as by welding a short orienting sleeve onto an upper section of mandrel having a slot cut internally therein, though an orientation housing created by welding two pieces together would not be as strong as the single piece design.

The orientation housing 52 comprises an upper section 56 and a lower section 58. The upper section 56 has an internal slot 60 (shown in shadow) cut longitudinally along its inner wall. This slot is of sufficient length to allow kickover tools to be aligned and activated for insertion into the side pocket section. The slot 60 has a shoulder 62 at its upper end to activate the kickover tool.

The lower section 58 of the orientation housing has a smaller outer diameter than the upper section 56, so that the lower section can be inserted into the lower housing 54. The lower section 58 comprises two guide surfaces 64, which can be symmetrical or asymmetrical, according to the usage of the side pocket mandrel. A single guide surface may also be used. The slot 60 that is cut along the inner wall of the upper section 56 of the orientation housing is operably aligned with the guide surfaces 64, so that the key of the kickover tool will be aligned with the slot by the guide surfaces as the kickover tool is raised through the side pocket mandrel. The lower section 58 may also contain a portion of the slot as shown at 66, though this is not necessary, and preferably most or all of the slot 60 is integrally formed inside the upper section 56 of the orientation housing, to keep the lower section 58 as short as possible.

Referring now to FIG. 3, the orientation housing 52, once constructed by whatever method, is fully inserted into the lower mandrel housing 54. The orientation housing and the lower housing are then welded together with welds 68. The two housings could also be joined in any number of other methods well known in the art.

The fully constructed side pocket mandrel utilizing the invention then operates in a similar manner to those in the prior art. The inventive mandrel however presents far less area for crevice corrosion, and is much more resistant to breakage due to lateral loading. Further, use of the inventive side pocket mandrel completely precludes having an orienting sleeve come loose inside the mandrel. Thus it has been shown that the inventive side pocket mandrel illustrated and described herein fulfills the object of the invention set forth at the beginning of this application.

The foregoing description and drawings of the invention are explanatory and illustrative thereof, and various changes in sizes, shapes, materials, and arrangement of parts, as well as certain details of the illustrated construction, may be made within the scope of the appended claims without departing from the true spirit of the invention. Accordingly, while the present invention has been described herein in detail to its preferred embodiment, it is to be understood that this disclosure is only illustrative and exemplary of the present invention and is made merely for the purposes of providing and enabling disclosure of the invention. The foregoing disclosure is neither intended nor to be construed to limit the present invention or otherwise to exclude any such embodiments, adaptations, variations, modifications, and equivalent arrangements, the present invention being limited only by the claims appended hereto and the equivalents thereof.

We claim:

1. An orientation housing for use in side pocket mandrels used in oil and gas well production, said orientation housing having an inner and outer surface, a generally circular cross-section, and a primary longitudinal bore therethrough, said orientation housing comprising:

an upper section having a longitudinally-aligned orienting slot formed on said inner surface, and a lower section having at least one orienting guide surface, said at least one guide surface being operably aligned with said orienting slot;

wherein said upper section of said orientation housing has a first generally uniform outer diameter, and wherein said lower section of said orientation housing has a second, generally uniform outer diameter.

2. The orientation housing of claim 1, wherein said orientation housing is manufactured out of a single piece of metal.

3. The orientation housing of claim 2, wherein said manufacturing process is machining from a single piece of metal.

4. The orientation housing of claim 1, wherein said at least one guide surface comprises two asymmetrical guide surfaces.

5. The orientation housing of claim 1, wherein said lower section of said orientation housing is solely comprised of said at least one guide surface.

6. A side pocket mandrel for use in oil and gas well production, comprising:

an orientation housing, said orientation housing having an inner and outer surface, a generally circular cross-section, and a primary longitudinal bore therethrough, said orientation housing comprising an upper section having a longitudinally-aligned orienting slot formed on said inner surface, and a lower section having at least one orienting guide surface, said guide surface operably aligned with said orienting slot;

wherein said upper section of said orientation housing has a first generally uniform outer diameter, and wherein said lower section of said orientation housing has a second, generally uniform outer diameter which is smaller than said orientation housing upper section outer diameter; and a second housing section, said second housing section operably connected to a side pocket section, said second housing section being operably connected to said orientation housing.

7. The side pocket mandrel of claim 6, wherein said orientation housing is manufactured out of a single piece of metal.

8. The side pocket mandrel of claim 7, wherein said manufacturing process is machining from a single piece of metal.

9. The side pocket mandrel of claim 6, wherein said at least one guide surface comprises two asymmetrical guide surfaces. which is smaller than said orientation housing upper section outer diameter.

10. The side pocket mandrel of claim 6, wherein said lower section of said orientation housing is solely comprised of said at least one guide surface.

* * * * *

UNITED STATES PATENT AND TRADEMARK OFFICE

CERTIFICATE OF CORRECTION

PATENT NO. : 5,862,859

DATED : JANUARY 26, 1999

INVENTORS : DAVID SPEED/ROBERT SHARUM

It is certified that error appears in the above-identified patent and that said Letters Patent is hereby corrected as shown below:

In claim 1, col. 5, line 31, after "diameter" and before the period, insert –which is smaller than said orientation housing upper section outer diameter--.

In claim 9, col. 6, lines 34-35, after "surfaces" delete ", which is smaller than said orientation housing upper section outer diameter".

Signed and Sealed this

Twenty-fifth Day of May, 1999

*Attest:*

Q. TODD DICKINSON

*Attesting Officer*

*Acting Commissioner of Patents and Trademarks*